US009062467B1

(12) United States Patent
Hanson

(10) Patent No.: US 9,062,467 B1
(45) Date of Patent: Jun. 23, 2015

(54) FRAMING TOOL

(71) Applicant: Dean R. Hanson, Paynesville, MN (US)

(72) Inventor: Dean R. Hanson, Paynesville, MN (US)

( * ) Notice: Subject to any disclaimer, the term of this patent is extended or adjusted under 35 U.S.C. 154(b) by 218 days.

(21) Appl. No.: 13/860,854

(22) Filed: Apr. 11, 2013

(51) Int. Cl.
*E04G 21/18* (2006.01)
*B25B 5/14* (2006.01)
*B25B 11/02* (2006.01)

(52) U.S. Cl.
CPC ..... *E04G 21/1891* (2013.01); *B25B 5/142* (2013.01); *B25B 11/02* (2013.01)

(58) Field of Classification Search
CPC ..... B25B 5/00; B25B 5/14; B25B 5/142; B25B 11/02
USPC ..... 269/40, 41
See application file for complete search history.

(56) References Cited

U.S. PATENT DOCUMENTS

| | | | | | |
|---|---|---|---|---|---|
| 2,220,794 | A | * | 11/1940 | Pearce | 83/762 |
| 2,669,957 | A | * | 2/1954 | De Vogt | 269/107 |
| 2,911,690 | A | | 11/1959 | Sanford | |
| 3,072,396 | A | * | 1/1963 | McBurney | 269/45 |
| 3,256,030 | A | | 6/1966 | Banse | |
| 3,682,467 | A | * | 8/1972 | Heinrich | 269/88 |
| 3,935,779 | A | * | 2/1976 | Hildebrandt et al. | 83/762 |
| 4,024,691 | A | | 5/1977 | Hansen | |
| 4,033,570 | A | * | 7/1977 | Curlow | 269/41 |
| D271,660 | S | * | 12/1983 | Elmore et al. | D8/71 |
| 4,713,923 | A | | 12/1987 | Sielaff | |
| 5,349,800 | A | | 9/1994 | Peng | |
| 5,360,212 | A | * | 11/1994 | West | 269/40 |
| D363,201 | S | * | 10/1995 | Hill et al. | D8/71 |
| 5,913,546 | A | * | 6/1999 | Kuchenbrod et al. | 29/464 |
| 6,391,144 | B1 | * | 5/2002 | Gilbert, Jr. | 156/304.1 |
| 6,625,944 | B2 | | 9/2003 | Mackay | |
| 7,708,261 | B2 | * | 5/2010 | Cullen | 269/41 |
| 8,678,366 | B2 | * | 3/2014 | Bowers | 269/289 R |
| 2002/0166299 | A1 | | 11/2002 | Day | |
| 2004/0007803 | A1 | * | 1/2004 | Wong | 269/41 |
| 2005/0163564 | A1 | | 7/2005 | Tuell | |
| 2008/0159805 | A1 | | 7/2008 | Lasusa | |
| 2011/0303813 | A1 | * | 12/2011 | Lijesnic | 248/309.1 |

* cited by examiner

*Primary Examiner* — Lee D Wilson
*Assistant Examiner* — Tyrone V Hall, Jr.
(74) *Attorney, Agent, or Firm* — Neustel Law Offices

(57) ABSTRACT

A framing tool for accurately and easily supporting framing materials at a right angle with respect to each other so that they may be fastened together. The framing tool generally includes a base portion having an upper surface which includes a pair of slots oriented at a right angle with respect to each other. The first slot is defined by a first outer wall and first inner wall extending upwardly from the upper surface of the base portion adjacent to a first side edge thereof. The second slot is defined by a second outer wall and second inner wall extending upwardly from the upper surface of the base portion adjacent to a second side edge thereof. The two slots of the present invention are adapted to receive a pair of pieces of lumber to be fastened together at a right angle.

18 Claims, 6 Drawing Sheets

FRAMING TOOL

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a framing device and more specifically it relates to a framing tool for accurately and easily supporting framing materials at a right angle with respect to each other so that they may be fastened together.

2. Description of the Related Art

Any discussion of the related art throughout the specification should in no way be considered as an admission that such related art is widely known or forms part of common general knowledge in the field.

During the course of construction of various structures, it is often necessary to fasten a first material to a second material at a right angle, such as in framing lumber for roofs, walls and the like. When securing lumber in such a manner, it is often necessary to use rulers or other framing aids to ensure the proper angle between the two pieces being fastened together. Even a miscalculation of a few degrees can lead to structural instability or wasted materials.

In the past, such materials are hand-held in their proper orientation prior to fastening. Alternatively, increasingly complex and sometimes potentially dangerous devices may be utilized to ensure proper fitting of the materials together. When forced to hold the materials in a certain orientation, multiple individuals may be necessary and there is always the risk of error or injury due to an individual's hands being present near the area being fastened.

Because of the inherent problems with the related art, there is a need for a new and improved framing tool for accurately and easily supporting framing materials at a right angle with respect to each other so that they may be fastened together.

BRIEF SUMMARY OF THE INVENTION

The invention generally relates to a framing tool which includes a base portion having an upper surface which includes a pair of slots oriented at a right angle with respect to each other. The first slot is defined by a first outer wall and first inner wall extending upwardly from the upper surface of the base portion adjacent to a first side edge thereof. The second slot is defined by a second outer wall and second inner wall extending upwardly from the upper surface of the base portion adjacent to a second side edge thereof. The two slots of the present invention are adapted to receive a pair of pieces of lumber to be fastened together at a right angle.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
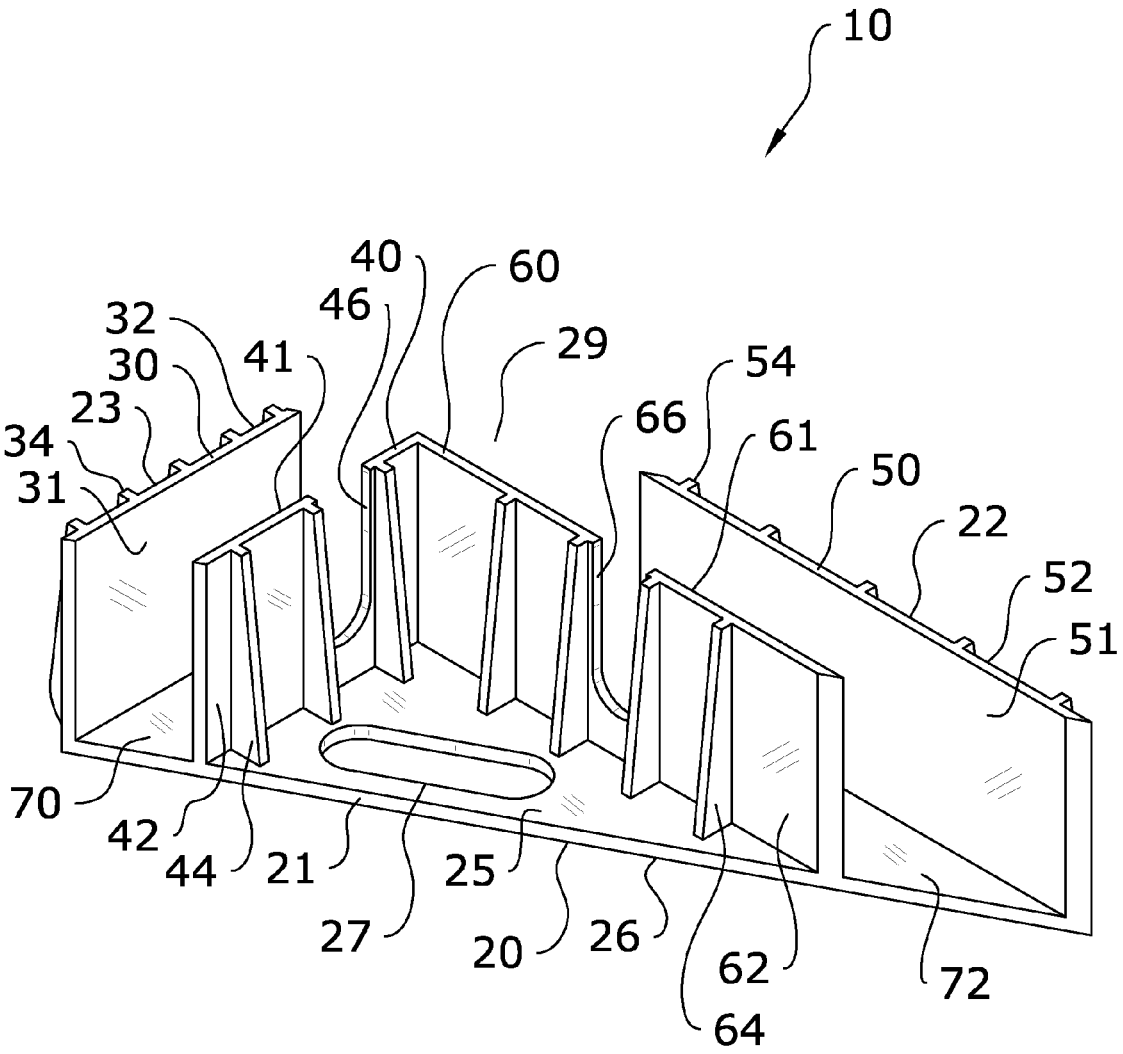
FIG. 1 is an upper perspective view of the present invention.

Turning now descriptively to the drawings, in which similar reference characters denote similar elements throughout the several views, FIGS. 1 through 8 illustrate a framing tool 10, which comprises a base portion 20 having an upper surface 25 which includes a pair of slots 70, 72 oriented at a right angle with respect to each other. The first slot 70 is defined by a first outer wall 30 and first inner wall 40 extending upwardly from the upper surface 25 of the base portion 20 adjacent to a first side edge 23 thereof. The second slot 72 is defined by a second outer wall 50 and second inner wall 60 extending upwardly from the upper surface 25 of the base portion 20 adjacent to a second side edge 23 thereof. The two slots 70, 72 of the present invention are adapted to receive a pair of pieces of lumber 12 to be fastened together at a right angle.

The present application illustrates three differently-sized embodiments of the present invention. It is appreciated that these are merely exemplary and various other embodiments may be utilized to secure a wide range of objects with a wide range of dimensions.

FIG. 1 illustrates a main embodiment which is adapted for use with 2×4, 2×6 and 2×8 or larger dimensioned lumber 12. This main embodiment is ideal for use with framing a stud wall, building a deck rail or any number of other construction projects.

Figure 7:
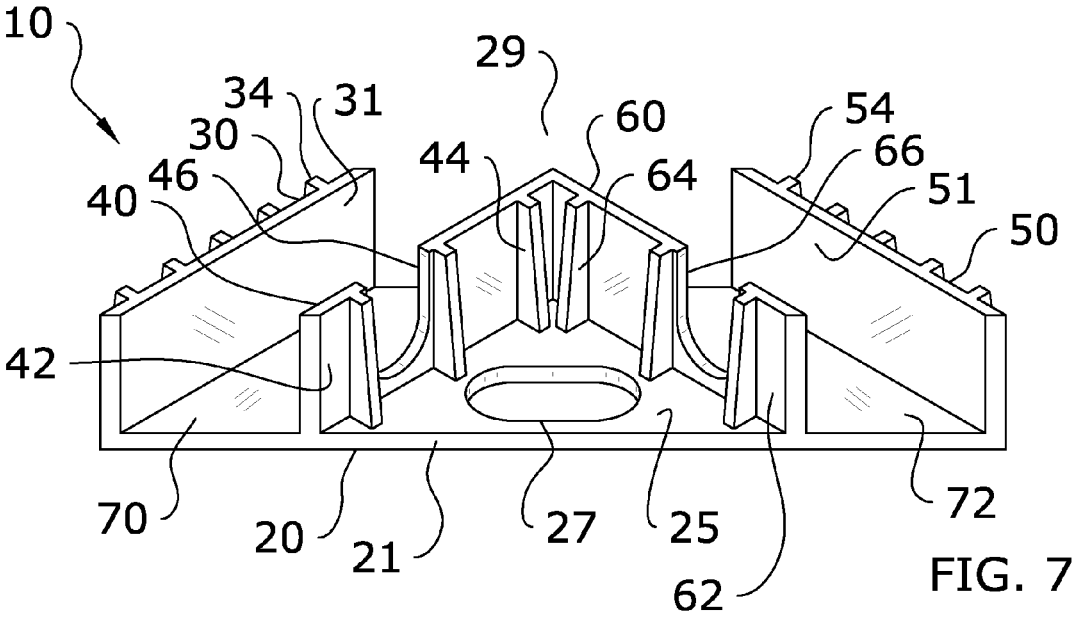
FIG. 7 is a frontal perspective view of a first alternate embodiment of the present invention.

FIG. 7 illustrates a first alternate embodiment which is adapted for use with 2×2 framework, such as in connection with framing a basement wall in preparation for sheet rock, building a dog house or various other projects.

Figure 8:
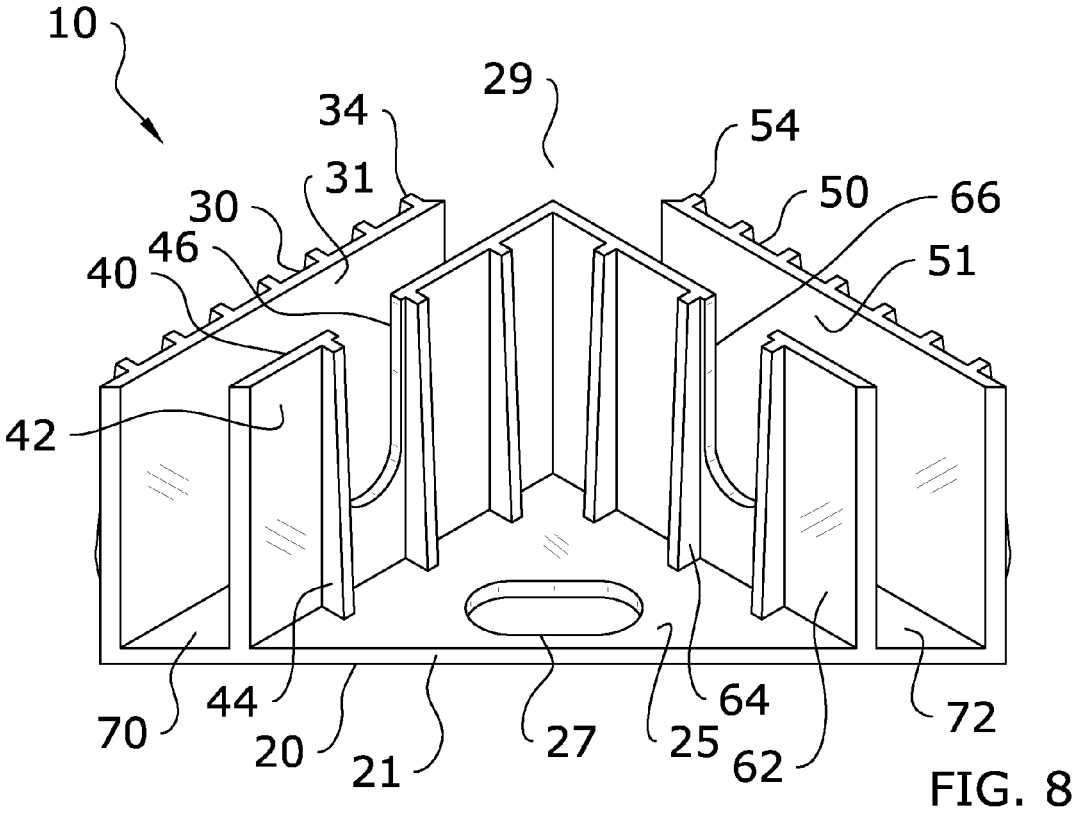
FIG. 8 is a frontal perspective view of a second alternate embodiment of the present invention.

FIG. 8 illustrates a second alternate embodiment which is adapted for use with 1×4, 1×6 and 1×8 or larger materials. This embodiment is ideal for use in framing doors and windows, building furniture, bookcases, planter boxes or other projects.

B. Base Portion

The present invention includes a base portion 20 from which the various walls 30, 40, 50, 60 of the present invention extend upwardly as shown in FIG. 1. The base portion 20 may be integrally formed of a unitary structure with the walls 30, 40, 50, 60 or, in some embodiments, some or all of the walls 30, 40, 50, 60 may be removably secured thereto.

It should be appreciated that the shape of the base portion 20 may vary in different embodiments. The scope of the present invention should not be construed as being limited to the specific shape of the base portion 20, as it is appreciated that various other configurations may be utilized to the same effect.

Figure 5:
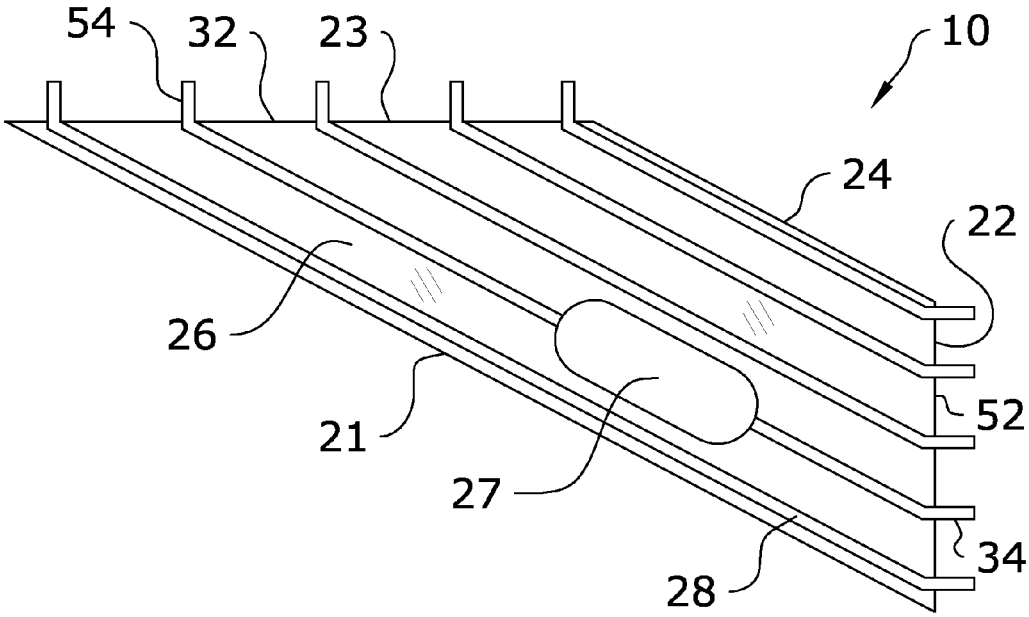
FIG. 5 is a bottom view of the present invention.
Figure 6:
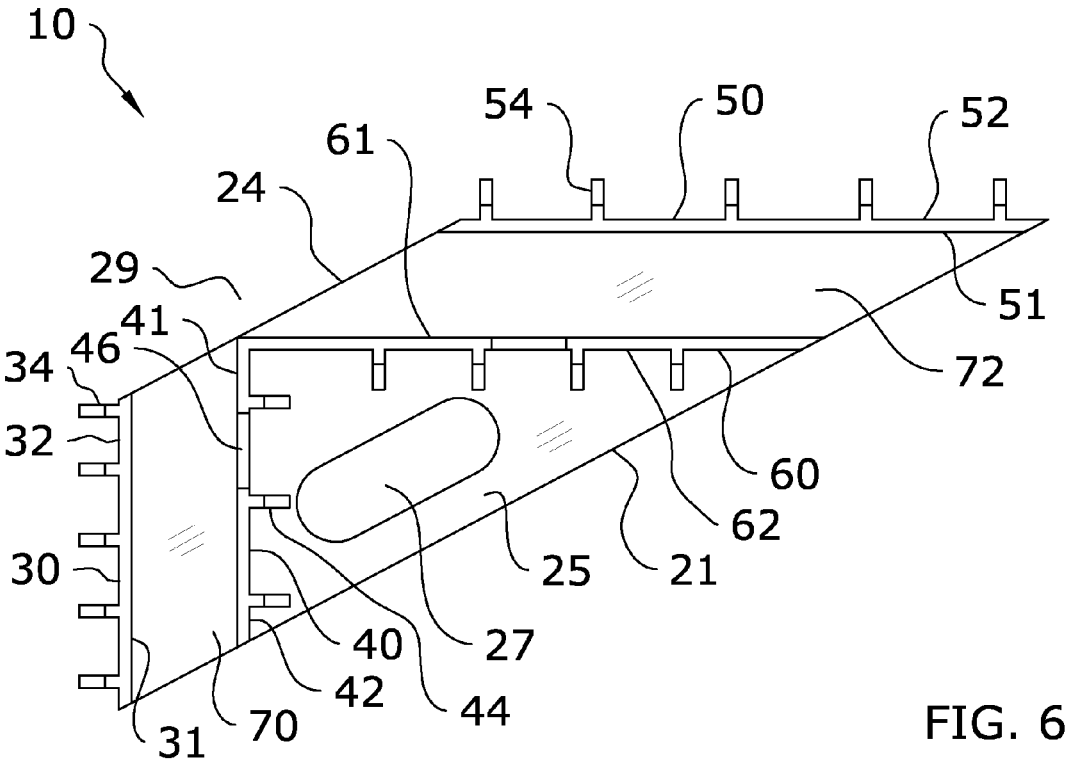
FIG. 6 is a top view of the present invention.

In a preferred embodiment as shown in FIG. 1, the base portion 20 is comprised of a polygonal shape having a front edge 21, a first side edge 22, a second side edge 23 and a rear edge 24. The first and second side edges 22, 23 preferably extend perpendicularly with respect to each other and are linked at their respective front ends by the front edge 21, which extends diagonally. The rear ends of the side edges 22, 23 are linked by the rear edge 24 of the base portion 20, which preferably extends in a parallel direction with respect to the front edge 21. In some embodiments, the front edge 21 will be of a greater length than that of the rear edge 24 and the first side edge 22 will be comprised of a shorter length than that of the second side edge 23 as best shown in FIGS. 5 and 6.

Figure 2:
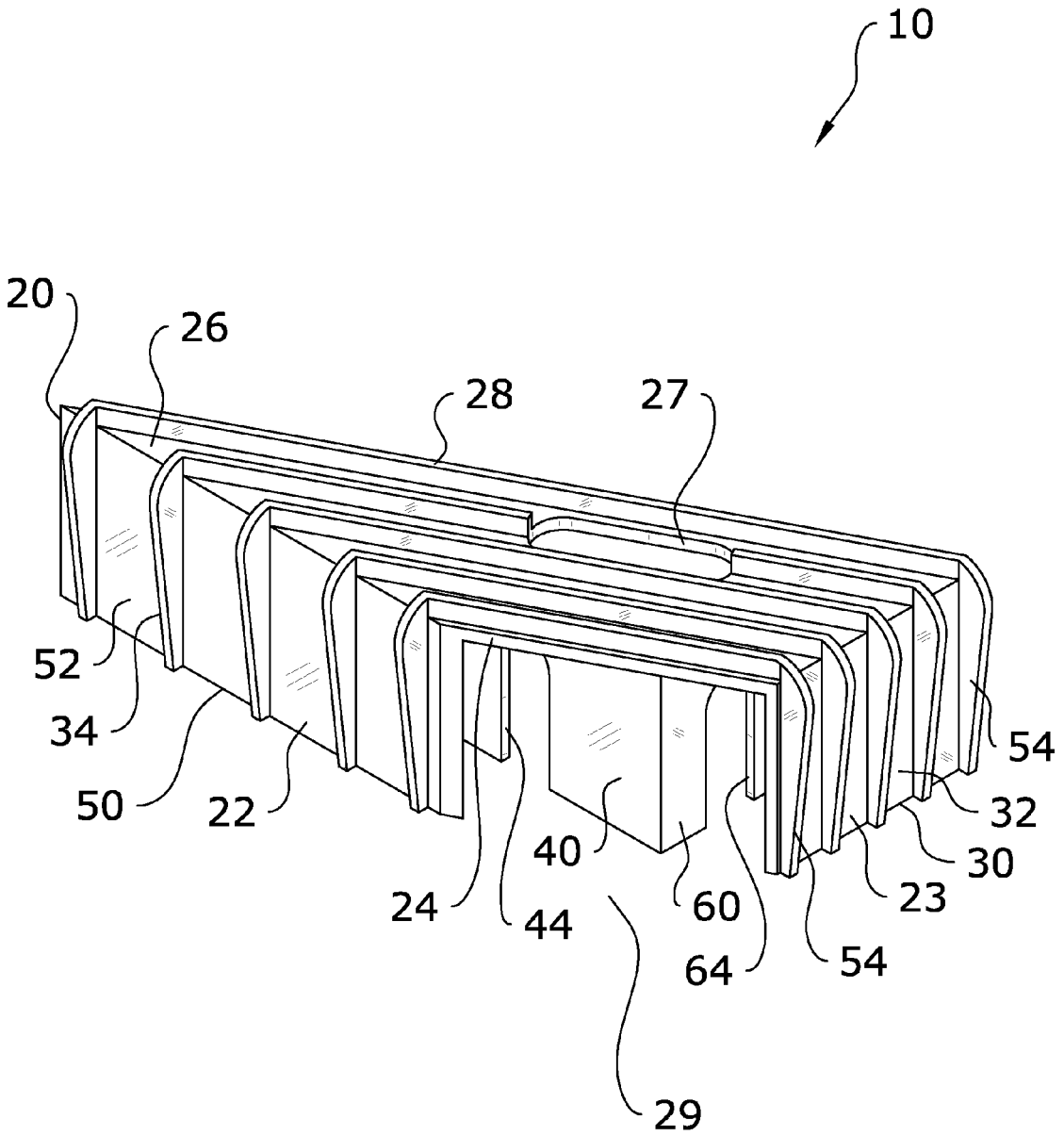
FIG. 2 is a lower perspective view of the present invention.

The base portion 20 includes an upper surface 25 and a lower surface 26. The walls 30, 40, 50, 60 of the present invention extend upwardly from the upper surface 25 of the base portion 20 to define a pair of slots 70, 72 and a rear gap 29 as shown in FIG. 1. The rear gap 29 allows full access to the lumber 12 being fastened so that fasteners may be inserted at various positions relative to the intersection of the lumber 12. A plurality of support ribs 28 extend across the lower surface 26 of the base portion 20 as shown in FIG. 2 which act to strengthen the base portion 20 and act as a resting structure to keep the base portion 20 flatly aligned with the ground.

A handle slot 27 may be formed within the base portion 20 to allow the present invention to be easily carried to different locations. The handle slot 27 may be positioned at any location on the base portion 20, but will preferably be positioned adjacent the base portion's 20 front edge 21 between its first and second side edges 22, 23 as shown in FIG. 1.

C. First Slot

The present invention includes a first slot 70 which is adapted to snugly receive a material such as lumber 12 to secure therein as it is fastened to a second material. The first slot 70 is defined by a first outer wall 30 positioned adjacent the first side edge 22 of the base portion 20 and a first inner wall 40 which extends parallel with respect to the first outer wall 30 in spaced relation so as to define the slot 70.

The first outer wall 30 is comprised of an elongated rim which extends upwardly from the upper surface 25 of the base portion 20 at its first side edge 22. The inner edge 31 of the first outer wall 30 is generally smooth so as to allow a snug fit for the lumber 12 to be placed therein. The outer edge 32 of the first outer wall 30 may include a plurality of support ribs 34 which extend vertically thereacross to provide structural support thereto. The support ribs 34 may be integrally formed and linked with the support ribs 28 extending across the lower surface 26 of the base portion 20 as best shown in FIG. 2.

The first inner wall 40 is similarly comprised of an elongated, raised wall-like structure which extends upwardly from the upper surface 25 of the base portion 20 at a position parallel and spaced-apart with respect to the first outer wall 30 so as to form the first slot 70 therebetween. The inner edge 41 of the first inner wall 40 is generally smooth and the outer edge 42 of the first inner wall 40 may include a plurality of support ribs 44 which extend vertically thereacross to provide structural support thereto.

The first inner wall 40 may include one or more cut-out portions 46 for accommodating various tools which may need access to any lumber 12 fit within the first slot 70, such as a clamp 14. The cut-out portions 46 may be comprised of various shapes and sizes such as the U-shaped cut-out portions 46 shown in the figures.

D. Second Slot

The present invention also includes a second slot 72 which is adapted to receive a second piece of lumber 12 to be fastened at a right angle to a first piece of lumber 12 being positioned within the first slot 70, such as for framing a roof. The second slot 72 is defined by a second outer wall 50 positioned adjacent the second side edge 23 of the base portion 20 and a second inner wall 60 which extends parallel with respect to the second outer wall 50 in spaced relation so as to define the slot 72.

The second outer wall 50 is comprised of an elongated rim which extends upwardly from the upper surface 25 of the base portion 20 at its second side edge 23. The inner edge 51 of the second outer wall 50 is generally smooth so as to allow a snug fit for the lumber 12 to be placed therein. The outer edge 52 of the second outer wall 50 may include a plurality of support ribs 54 which extend vertically thereacross to provide structural support thereto. The support ribs 54 may be integrally formed and linked with the support ribs 28 extending across the lower surface 26 of the base portion 20 as best shown in FIG. 2.

The second inner wall 60 is similarly comprised of an elongated, raised wall-like structure which extends upwardly from the upper surface 25 of the base portion 20 at a position parallel and spaced-apart with respect to the second outer wall 50 so as to form the second slot 72 therebetween. The inner edge 61 of the second inner wall 60 is generally smooth and the outer edge 62 of the second inner wall 60 may include a plurality of support ribs 64 which extend vertically thereacross to provide structural support thereto.

The second inner wall 60 may include one or more cut-out portions 66 for accommodating various tools which may need access to any lumber 12 fit within the second slot 72, such as a clamp 14. The cut-out portions 66 may be comprised of various shapes and sizes such as the U-shaped cut-out portions 66 shown in the figures.

E. Operation of Preferred Embodiment

Figure 3:
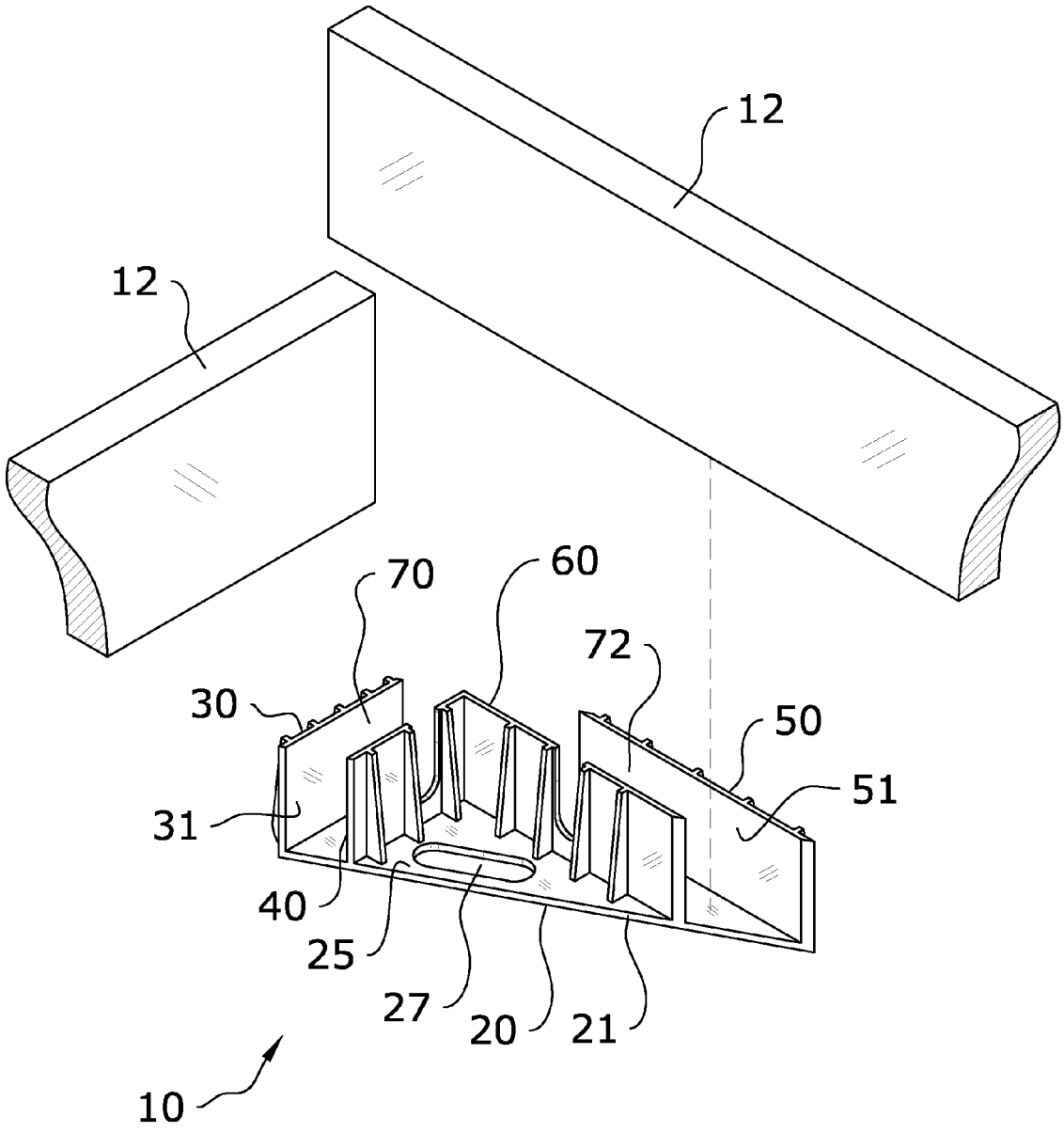
FIG. 3 is an upper perspective view illustrating positioning of lumber within the present invention.
Figure 4:
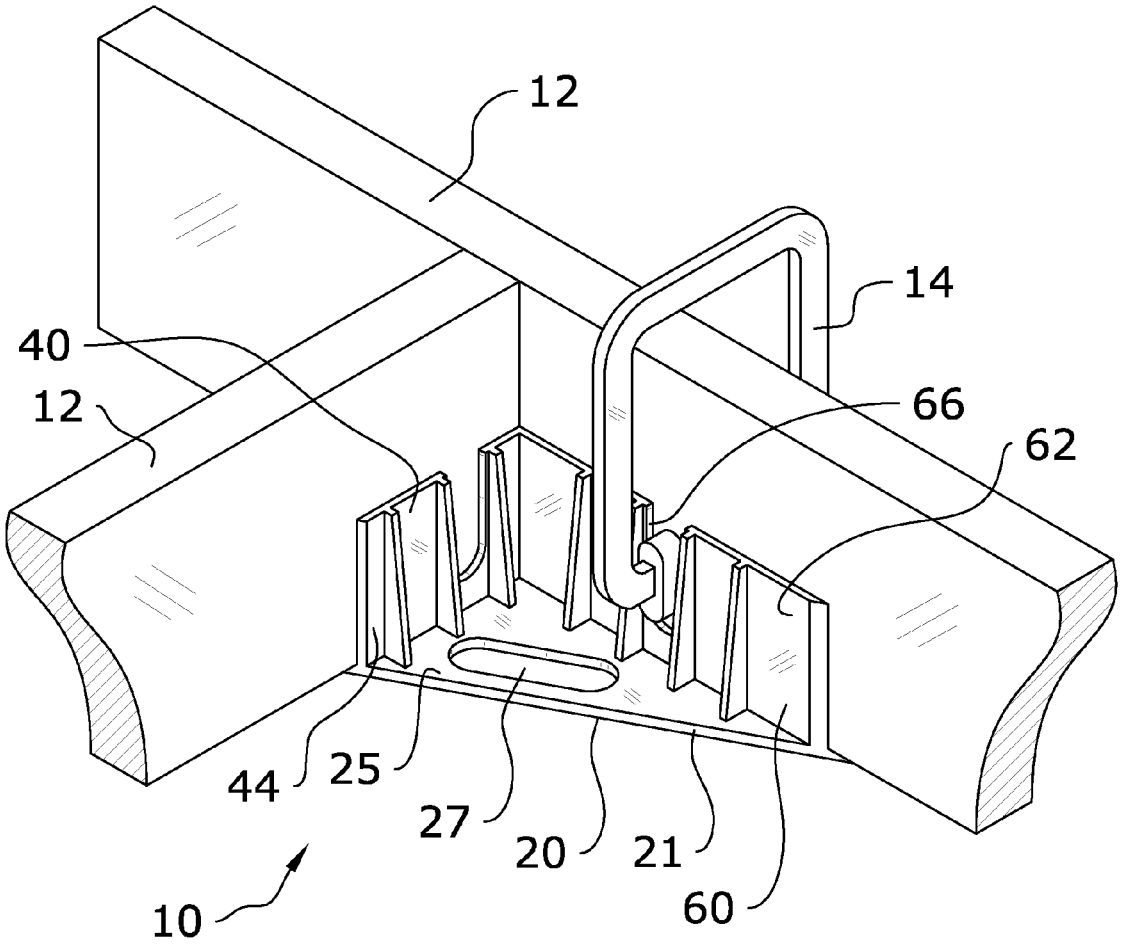
FIG. 4 is an upper perspective view of lumber being secured within the present invention by a clamp.

In use, a first piece of lumber 12 is positioned within the first slot 70 and a second piece of lumber 12 is positioned within the second slot 72 as shown in FIG. 3. One or more clamps 14 may be secured to the lumber 12 through the cut-out portions 46, 66 as shown in FIG. 4 to improve stability. With the pieces of lumber 12 secured within the slots 70, 72 at a right angle with respect to each other, they may be fastened together and removed so that additional lumber 12 may be so fastened together, such as for framing.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A lumber framing device, comprising:

a base portion;

a first slot on an upper surface of said base portion for receiving a first piece of lumber, wherein said first slot is defined between a first outer wall and a first inner wall;

a second slot on an upper surface of said base portion for receiving a second piece of lumber, wherein said second slot is defined between a second outer wall and a second inner wall;

a plurality of support ribs extending across an outer edge of said first outer wall, a lower surface of said base portion and an outer edge of said second outer wall; and wherein said first slot extends in a perpendicular direction with respect to said second slot.

2. The lumber framing device of claim 1, wherein said first outer wall is positioned adjacent a first side edge of said base portion.

3. The lumber framing device of claim 2, wherein said first inner wall extends parallel with respect to said first outer wall to form said first slot.

4. The lumber framing device of claim 3, wherein said second outer wall is positioned adjacent a second side edge of said base portion.

5. The lumber framing device of claim 4, wherein said second inner wall extends parallel with respect to said second outer wall.

6. The lumber framing device of claim 1, wherein said first inner wall includes a first cut-out portion for receiving a first clamp.

7. The lumber framing device of claim 6, wherein said second inner wall includes a second cut-out portion for receiving a second clamp.

8. The lumber framing device of claim 7, wherein said first cut-out portion and said second cut-out portion are each comprised of a U-shaped cut-out.

9. A lumber framing device, comprising:

a base portion, wherein said base portion includes a front edge, a first side edge and a second side edge;

a first outer wall extending upwardly from said base portion adjacent said first side edge;

a first inner wall extending upwardly from said base portion parallel with respect to said first outer wall to form a first slot;

a second outer wall extending upwardly from said base portion adjacent said second side edge;

a second inner wall extending upwardly from said base portion parallel with respect to said second outer wall to form a second slot;

a first plurality of support ribs extending vertically along an outer edge of said first outer wall; and wherein said first slot and said second slot extend perpendicularly with respect to each other.

10. The lumber framing device of claim 9, wherein said first inner wall includes a first cut-out portion for receiving a first clamp.

11. The lumber framing device of claim 10, wherein said second inner wall includes a second cut-out portion for receiving a second clamp.

12. The lumber framing device of claim 11, wherein said first cut-out portion and said second cut-out portion are each comprised of a U-shaped cut-out.

13. The lumber framing device of claim 10, further comprising a handle slot formed within said base portion.

14. The lumber framing device of claim 13, wherein said handle slot is positioned adjacent said front edge of said base portion.

15. The lumber framing device of claim 9, further comprising a second plurality of support ribs extending vertically along an outer edge of said second outer wall.

16. The lumber framing device of claim 15, further comprising a third plurality of support ribs extending along a lower surface of said base portion.

17. The lumber framing device of claim 16, wherein said first plurality of support ribs, said second plurality of support ribs and said third plurality of support ribs are integrally formed of a unitary structure.

18. A lumber framing device, comprising:

a base portion, wherein said base portion includes a front edge, a first side edge and a second side edge, a handle slot formed within said base portion, wherein said handle slot is positioned adjacent said front edge of said base portion;

a first outer wall extending upwardly from said base portion adjacent said first side edge;

a first inner wall extending upwardly from said base portion parallel with respect to said first outer wall to form a first slot, wherein said first inner wall includes a first cut-out portion for receiving a first clamp;

a second outer wall extending upwardly from said base portion adjacent said second side edge;

a second inner wall extending upwardly from said base portion parallel with respect to said second outer wall to form a second slot, wherein said second inner wall includes a second cut-out portion for receiving a second clamp, wherein said first cut-out portion and said second cut-out portion are each comprised of a U-shaped cut-out;

a first plurality of support ribs extending vertically along an outer edge of said first outer wall;

a second plurality of support ribs extending vertically along an outer edge of said second outer wall; and a third plurality of support ribs extending along a lower surface of said base portion;

wherein said first slot and said second slot extend perpendicularly with respect to each other.

* * * * *